US009566214B2

(12) United States Patent
Eitrheim et al.

(10) Patent No.: US 9,566,214 B2
(45) Date of Patent: Feb. 14, 2017

(54) PORTABLE SYSTEM OF PRESERVING AND INSTANTLY MIXING BABY FORMULA

(71) Applicants: John K. Eitrheim, Frisco, TX (US); Tracy W. Escobar, Midlothian, TX (US)

(72) Inventors: John K. Eitrheim, Frisco, TX (US); Tracy W. Escobar, Midlothian, TX (US)

(73) Assignee: Formulawise, Inc., Frisco, TX (US)

( * ) Notice: Subject to any disclaimer, the term of this patent is extended or adjusted under 35 U.S.C. 154(b) by 0 days.

(21) Appl. No.: 13/654,085

(22) Filed: Oct. 17, 2012

(65) Prior Publication Data

US 2014/0102918 A1 Apr. 17, 2014

(51) Int. Cl.

| | |
|---|---|
| ***B65D 25/08*** | (2006.01) |
| ***A61J 1/20*** | (2006.01) |
| ***A61J 9/00*** | (2006.01) |

(52) U.S. Cl.

CPC ..... *A61J 1/2093* (2013.01); *A61J 9/00* (2013.01)

(58) Field of Classification Search

CPC ..... A61J 1/2093; A61J 9/00; A61J 1/2037; A61J 1/2041

USPC .... 206/219, 221; 215/6, 322, 215, 220, 221, 215/255, 303; 220/258.4, 260, 267, 265, 277, 220/89.3

See application file for complete search history.

(56) References Cited

U.S. PATENT DOCUMENTS

| | | | | |
|---|---|---|---|---|
| 3,321,097 | A | 5/1967 | Solowey | |
| 4,221,291 | A | 9/1980 | Hunt | |
| 4,315,570 | A * | 2/1982 | Silver et al. | 206/221 |
| 5,275,298 | A | 1/1994 | Holley, Jr. et al. | |
| 5,484,410 | A * | 1/1996 | Kriesel | A61J 1/2089 604/410 |
| 5,634,714 | A | 6/1997 | Guild | |
| 6,019,197 | A * | 2/2000 | Judson | 188/1.11 W |
| 7,568,576 | B2 * | 8/2009 | Sweeney et al. | 206/219 |
| 8,430,137 | B2 * | 4/2013 | Sim | 141/322 |
| 8,590,700 | B2 * | 11/2013 | Yang et al. | 206/222 |
| 2007/0221601 | A1 * | 9/2007 | Eitrheim et al. | 215/6 |
| 2011/0108442 | A1 * | 5/2011 | Cho | 206/219 |
| 2013/0306499 | A1 * | 11/2013 | Lee et al. | 206/221 |
| 2014/0001064 | A1 * | 1/2014 | Aloia | 206/221 |

OTHER PUBLICATIONS

PCT International Search Report for related PCT/US2013/065304, dated Mar. 6, 2014, 3 pages.

PCT Written Opinion of the International Search Authority for related PCT/US2013/065304, dated Mar. 6, 2014, 4 pages.

* cited by examiner

*Primary Examiner* — Anthony Stashick
*Assistant Examiner* — James M Van Buskirk
(74) *Attorney, Agent, or Firm* — Kirby B. Drake; Klemchuk LLP

(57) ABSTRACT

A reusable, portable attachment for coupling in between a baby bottle top and a baby bottle container that comprises a container compartment for storing powdered formula separately from water prior to feeding, a hollow compartment, a removable seal therebetween, and a release actuator for releasing the seal to mix the powdered formula and water.

12 Claims, 4 Drawing Sheets

PORTABLE SYSTEM OF PRESERVING AND INSTANTLY MIXING BABY FORMULA

TECHNICAL FIELD

The present disclosure relates generally to baby bottle systems and methods, and in particular, to portable systems of preserving and instantly mixing baby formula that are installable on a plurality of existing baby bottles and easily operable by the user.

BACKGROUND

Infants require a specific amount of nutrients at specific times throughout the day. Often times such nutrients are delivered through formula. Formula is a powdered substance containing nutrients that is mixed with water to create liquid formula, which can then be fed to an infant.

There are times when mixing formula is inconvenient, such as outings away from home. Formula may be pre-mixed but it is typically recommended that pre-mixed formula be consumed within one hour of mixing, as the shelf life of mixed formula is about two hours. This can lead to wasted formula if the infant is not hungry within an hour of mixing.

Therefore, feeding formula either requires the transportation of powdered formula, water and a baby bottle separately, or the use of a device that stores baby formula into which water can be added to create formula. These devices are often expensive, complicated to manipulate, requiring finesse to use, and are difficult to clean.

SUMMARY

Embodiments of the present disclosure generally provide reusable, portable systems and methods of preserving powdered baby formula that can be instantly mixed when feeding is required.

In an embodiment, the present disclosure provides a portable system of preserving and instantly mixing baby formula comprising a formula retention compartment, a hollow compartment, a removable seal therebetween, and a release actuator for releasing the seal. The exterior surface of the formula retention compartment may be adapted to removably couple to a baby bottle top and the interior surface of the hollow compartment may be adapted to removably couple to a baby bottle container.

In one embodiment of the present disclosure, the removable seal may be a plug and the release actuator for releasing the seal may be a pushrod mechanism slidably disposed through one or more grommets within a channel. Optionally, a gasket may be included to provide a water tight seal between the hollow compartment and the baby bottle container. The gasket may have small grooves that allow air ventilation while maintaining a water tight seal.

In one embodiment, the present disclosure provides a portable method of preserving powdered formula and water separately until feeding is necessary, the method comprising disengaging the pushrod, inserting the plug to create a seal between the formula retention compartment and the hollow compartment, filling a baby bottle container with water, coupling the hollow compartment, to the baby bottle container, disbursing powdered formula into the formula retention compartment, and coupling a baby bottle top to the formula retention compartment.

In one embodiment, the present disclosure provides a portable method of instantly mixing baby formula when feeding is necessary, the method comprising engaging the pushrod to disengage the plug from the locked position, thereby allowing the plug to release the powdered formula from the formula retention compartment through the hollow compartment and into the baby bottle container, and mixing the powdered formula with the water in the baby bottle container to create liquid baby formula.

In one embodiment, the plug also releases into the baby bottle container to act as an agitator to assist in mixing the powdered formula and the water.

BRIEF DESCRIPTION OF THE DRAWINGS

For a more complete understanding of the present disclosure and its features, reference is now made to the following description, taken in conjunction with the accompanying drawings, in which.

DETAILED DESCRIPTION

The present disclosure generally provides a baby formula mixing system that preserves the integrity of the formula until feeding is desired, and provides a means for quickly mixing the formula.

Figure 1:
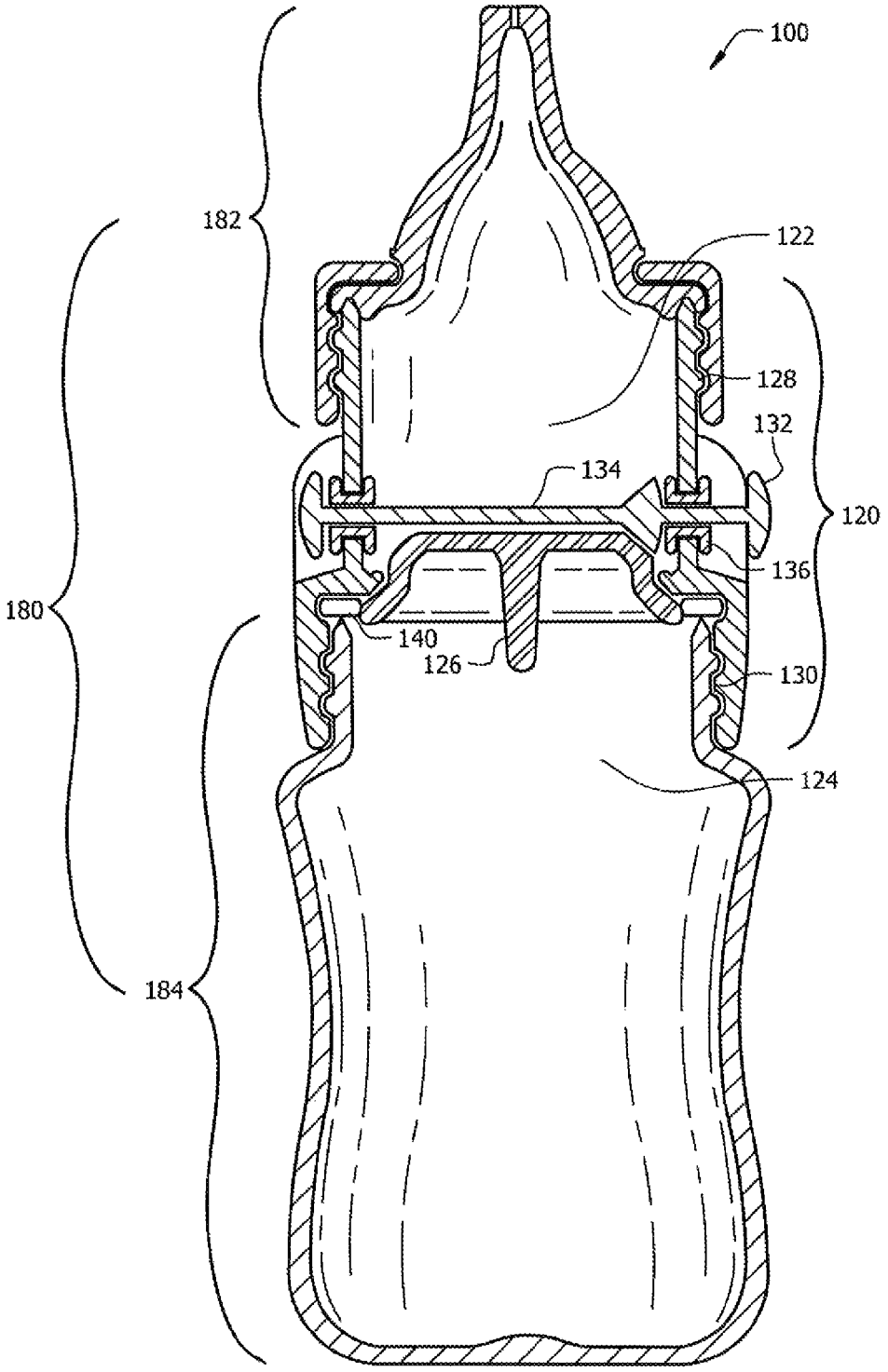
FIG. 1 is a front cross sectional view of a portable system of preserving and mixing baby formula in accordance with one embodiment of the present disclosure.

FIG. 1 generally illustrates a portable preservation and mixing system 100. It should be understood that system 100 shown in FIG. 1 is for illustrative purposes only and that any other suitable system or subsystem could be used in conjunction with or in lieu of system 100 according to one embodiment of the present disclosure.

System 100 may comprise a preservation and mixing attachment 120 that may be employed to preserve baby formula in powder form within a baby bottle 180 used for feeding. The baby formula can be easily mixed at the time of desired feeding.

The preservation and mixing attachment 120 may generally include a formula retention compartment 122 fixedly coupled vertically to a hollow compartment 124, and a plug 126 horizontally therebetween. In one embodiment, formula retention compartment 122 may be integrally formed with hollow compartment 124. In other embodiments, formula retention compartment 122 may be connected or otherwise coupled to hollow compartment 124 in any manner that fixedly secures formula retention compartment 122 to hollow compartment 124, including using male and female coupling adapters, ball and socket attachment, adhesive, glue, buckle, or using other suitable fastening materials, or any combination thereof.

In an embodiment, the formula retention compartment 122 may be adapted to removably couple to a baby bottle top 182 and the hollow compartment 124 may be adapted to removably couple to a baby bottle container 184.

The preservation and mixing attachment 120 may further comprise a pushrod 132 slidably disposed within a channel 134 and through a grommet 136, employed to disengage plug 126, and thereby releasing the powdered formula for mixing.

Optionally, a gasket 140 may be included to provide a better seal between the hollow compartment 124 and the baby bottle container 184.

Figure 5:
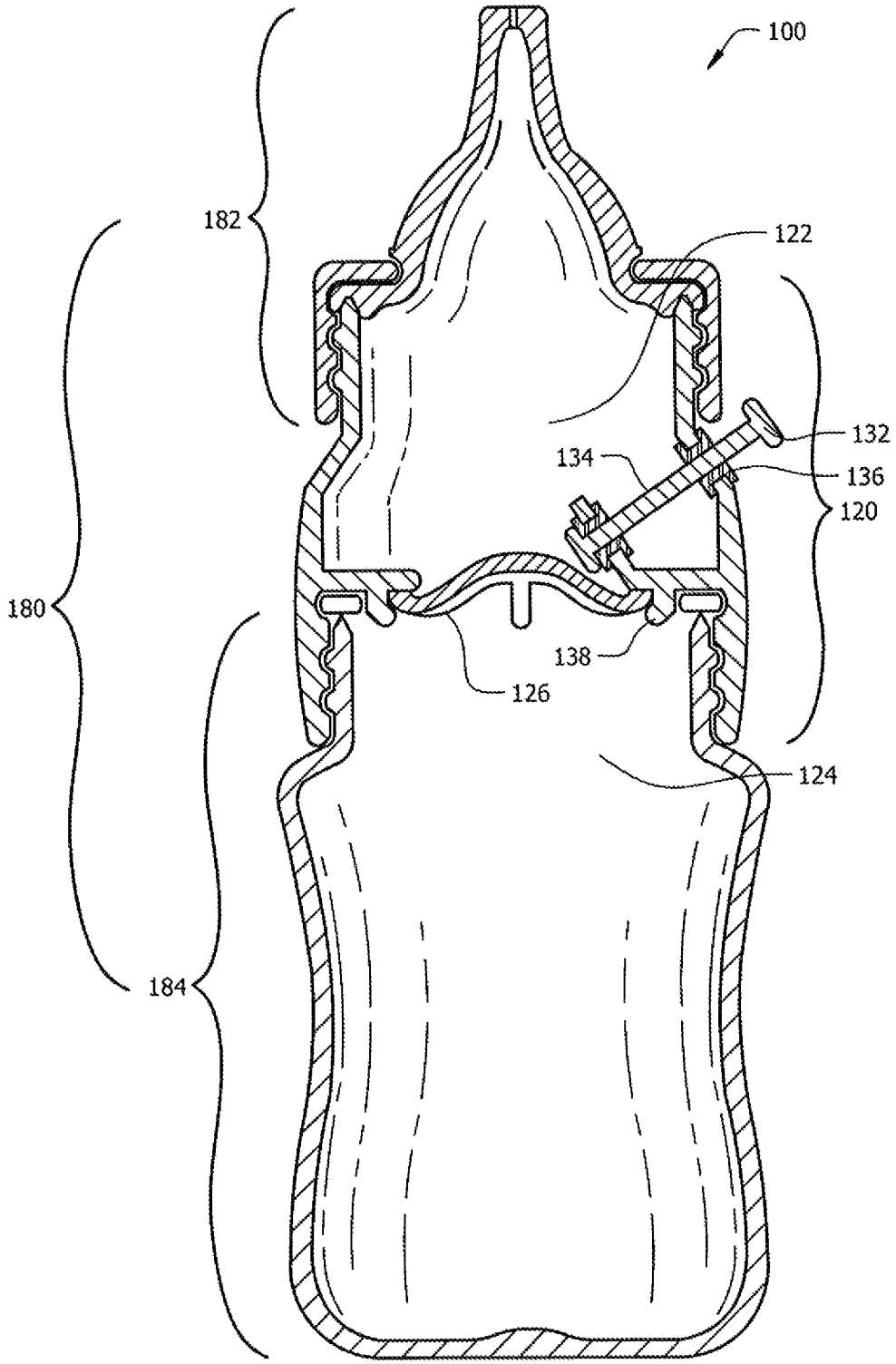
FIG. 5 is an exemplary illustration of a portable system of preserving and mixing baby formula according to an alternative embodiment of the present disclosure.

It should be understood that the pushrod 132 shown in FIG. 1 is for illustrative purposes only and that any other suitable mechanism could be used in conjunction with or in lieu of the pushrod 132 according to one embodiment of the present disclosure. In one embodiment, the pushrod 132 may have an angled surface that matches an angled surface of the plug 126, as shown in FIG. 1. This configuration allows the horizontal movement of the pushrod 132 to cause the vertical movement of the plug 126. Alternatively, the pushrod 132 may be directed at a downward angle, such that one end of the pushrod 132 is moved downward, as shown in FIG. 5. In alternative embodiments, the pushrod 132 may be configured as a key turn mechanism by having a flat handle at one or both ends suitable for rotation, and a paddle extending from the midsection of the pushrod 132 to make contact with the plug 126 when rotated. The pushrod 132 may be replaced operationally by a V-shaped strap attached to the inner walls of the formula retention compartment 122. When the formula retention compartment 122 is squeezed, the V-shaped strap collapses, causing downward movement at its vertex to release the plug 126. Other suitable mechanisms or a combination thereof may be employed to release the plug 126.

In operation, the user first resets the pushrod 132 by pushing on the end of the pushrod 132 opposite the end that is pushed to release the plug 126. The user next inserts the plug 126 into place through the hollow compartment 124, such that the plug 126 creates a barrier between the formula retention compartment 122 and the hollow compartment 124. The user then fills the baby bottle container 184 with water. The user next secures the preservation and mixing attachment 120 to the baby bottle container 184 through the hollow compartment 124. The user then disburses powdered formula into the formula retention compartment 122. Finally, the user secures the baby bottle top 182 to the preservation and mixing attachment 120 through the formula retention compartment 122.

When feeding is required, the user pushes the pushrod 132 from the outside of the preservation and mixing attachment 120, which causes the plug 126 to disengage from the locked position and release the powdered formula through the hollow compartment 124 and into the baby bottle container 184.

In one embodiment, the plug 126 also releases into the baby bottle container 184 to act as an agitator to assist in mixing the powdered formula and the water.

It should be understood that the operational steps described herein are for illustrative purposes only and that any other suitable method or sub-method could be used in conjunction with or in lieu of the steps described herein according to one embodiment of the present disclosure. It should also be understood that the steps described herein could be performed in any suitable order or manner.

Figure 2:
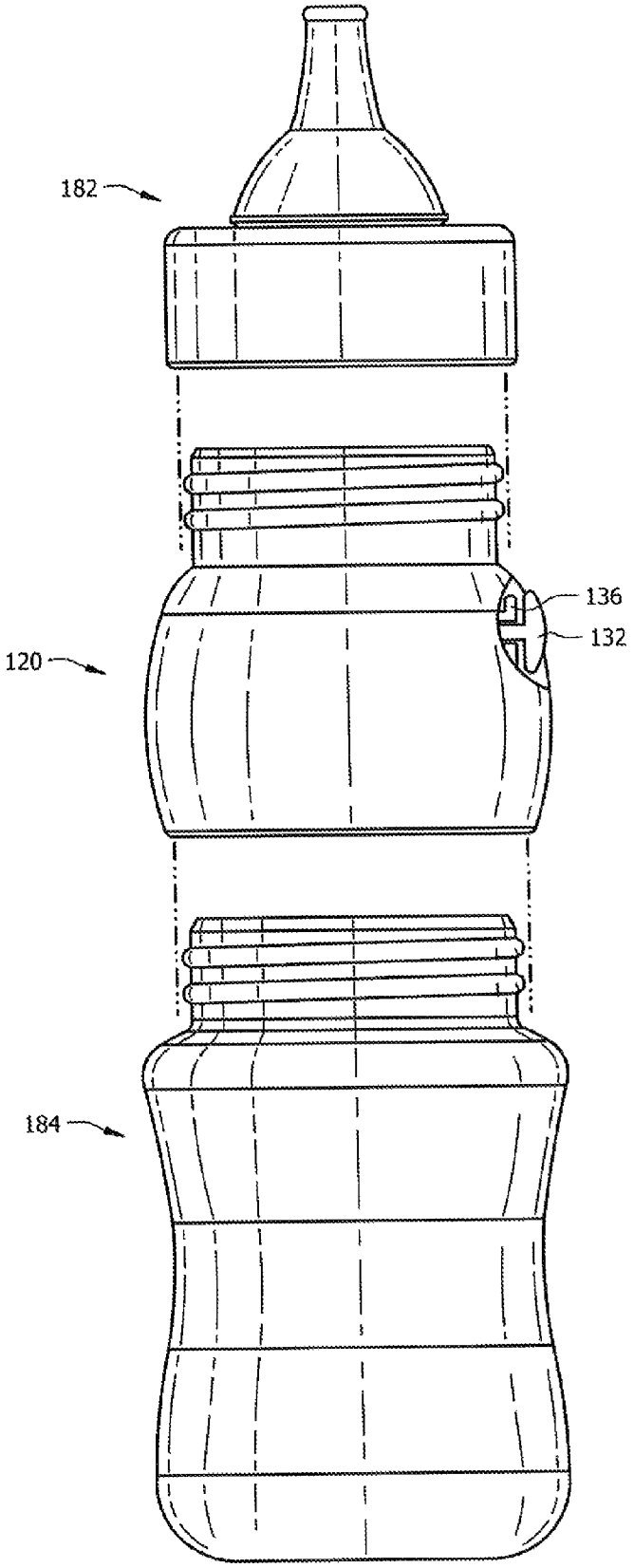
FIG. 2 is an exploded view of the portable preservation and mixing system of FIG. 1 according to one embodiment of the present disclosure.

FIG. 2 depicts an exploded view of system 100 of FIG. 1 according to one embodiment of the present disclosure.

In one embodiment, the preservation and mixing attachment 120 may include baby bottle top coupling threads 128 located on the exterior surface of the formula retention compartment 122 to allow the formula retention compartment 122 to removably couple to the baby bottle top 182, and baby bottle container coupling threads 130 located on the interior surface of the hollow compartment 124 to allow hollow compartment 124 to removably couple to the baby bottle container 184.

It should be understood that the preservation and mixing attachment 120 may be removably coupled to any of a variety of baby bottles 180 available in the market. More particularly, the baby battle top coupling threads 128 and the baby bottle container coupling threads 130 can be sized to fit the thread pattern of any desired baby bottle 180 available to consumers.

Figure 3:
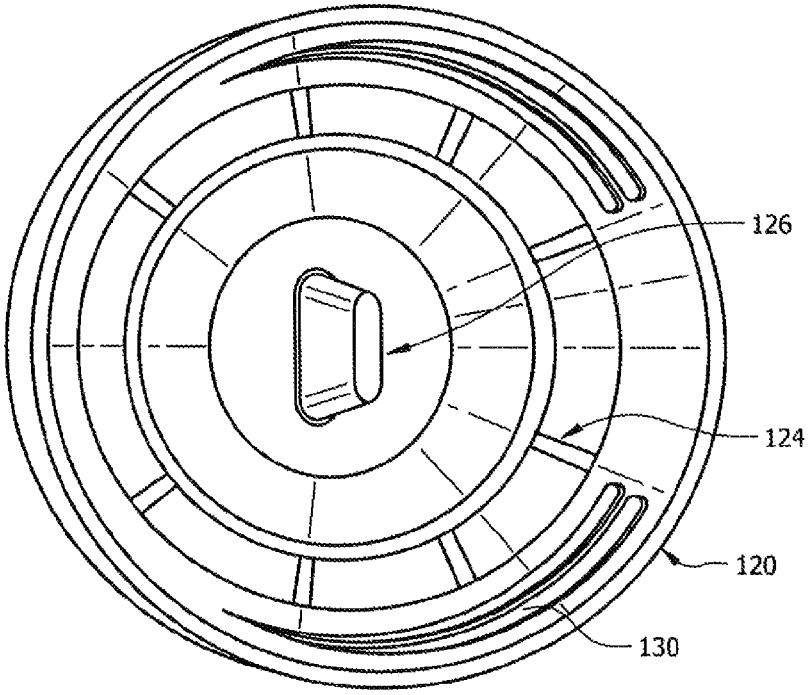
FIG. 3 is a bottom plan, view of a preservation and mixing attachment of FIG. 2 according to one embodiment of the present disclosure.

FIG. 3 illustrates a bottom plan view of the preservation and mixing attachment 120 of system 100 demonstrating plug 126 in the engaged or locked position according to one embodiment of the present disclosure.

In one embodiment, the plug 126 may be a compression fit stopper employed to prevent the flow of powdered formula from the formula retention compartment 122 into the hollow compartment 124 and the baby bottle container 184 before feeding. The compression fit can be done by making both the stopper and the opening it fits within slightly tapered, or by having a small lip on the plug which is wider than the opening, as shown in FIG. 1.

In alternative embodiments, as illustrated in FIG. 5, the plug 126 may be an inverted rubber stopper. An inverted rubber stopper is a spherical cap having an elastomeric body that is defined primarily by a first surface and a second surface. The elastomeric body is selectively positionable between a normal orientation, where the first surface faces outwardly, and an inverted orientation, where the second surface faces outwardly. In the inverted orientation, the spherical cap stores energy and stretches to an increased diameter to assist in forming a seal. When the inverted spherical cap is touched with a certain degree of force, the spherical cap reverts back to the normal orientation, thereby releasing the stored energy. In such embodiments, plug 126 is inserted to engage the grip 138 in the inverted orientation, and thereby create a barrier between formula retention compartment 122 and hollow compartment 124 utilizing the stored energy and increased diameter of the inverted plug 126. When the force of the pushrod 132 is employed to disengage plug 126, plug 126 is disengaged from the grip 138 and returns to the normal orientation.

In one embodiment, when the plug 126 is disengaged, plug 126 drops through the hollow compartment 124 and into the baby bottle container 184, thereby releasing the powdered formula from the formula retention compartment 122 through the hollow compartment 124 and into the baby bottle container 184. The plug 126 may then assist in mixing the powdered formula with the water located in the baby bottle container 184, as the user swirls or shakes the baby bottle 180.

In an alternative embodiment, the plug 126 may be partially coupled to the preservation and mixing attachment 120, such that when the plug 126 is disengaged it allows the powdered formula to release from the formula retention compartment 122 into the baby bottle container 184 but the plug 126, itself, does not fall into the baby bottle container 184.

Figure 4:
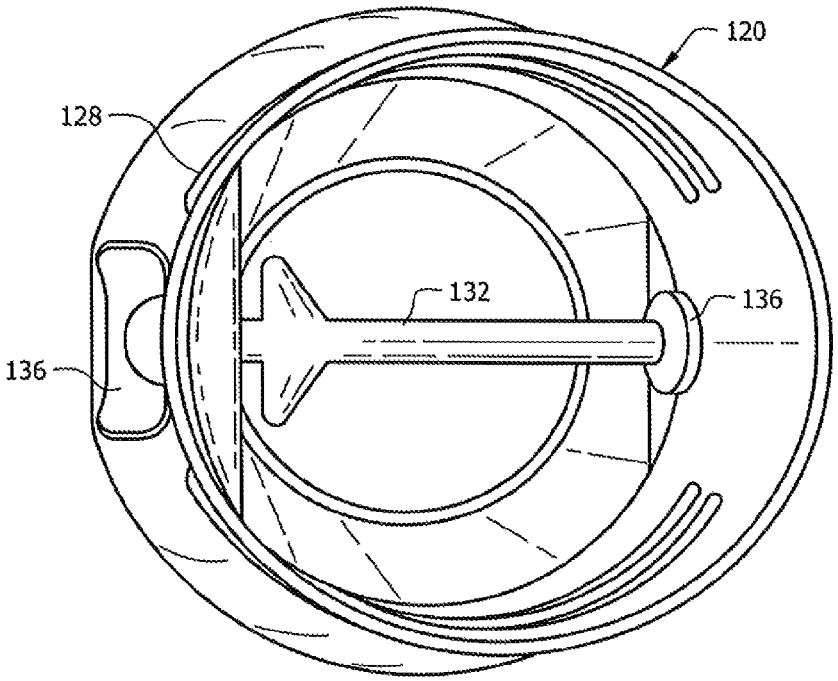
FIG. 4 is a top plan view of the preservation and mixing attachment of FIG. 2 in the engaged position according to one embodiment of the present disclosure.

FIG. 4 generally illustrates a top plan view of the preservation and mixing attachment 120 of system 100 demonstrating the pushrod 132 in the engaged position according to one embodiment of the present disclosure.

FIG. 5 depicts a cross sectional view of system 100 according to an alternative embodiment of the present disclosure.

In one embodiment, the formula retention compartment 122 may be connected or otherwise coupled to the baby bottle top 182 in any manner that allows the preservation and mixing attachment 120 to be removably coupled to baby bottle top 182, such as, for example, using baby bottle top coupling threads 128 as shown in FIG. 2, or any other suitable method including having male and female coupling adapters, snap close attachment, or using other suitable coupling materials, or any combination thereof.

In one embodiment, the hollow compartment 124 may be connected or otherwise coupled to the baby bottle container 184 in any manner that allows the preservation and mixing attachment 120 to be removably coupled to baby bottle container 184, such as, for example, using baby bottle container coupling threads 130 as shown in FIG. 2, or any other suitable method including having male and female coupling adapters, snap close attachment, or using other suitable coupling materials, or any combination thereof.

Any of formula retention compartment 122, hollow compartment 124, grip 138, baby bottle, top coupling threads 128 and/or baby bottle container coupling threads may be made of co-polyester, polypropylene, glass, polycarbonate, polyethersulfone, other sturdy, transparent or translucent material, other suitable materials, or any combination thereof.

The plug 126 may be made of polypropylene, silicone rubber, other flexible material resistant to stress cracking, other suitable materials, or any combination thereof.

The pushrod 132 may be made of nylon, other low friction material resistant to breakage, other suitable materials, or any combination thereof according to one embodiment of the present disclosure.

In an embodiment, any of the grommet 136 and the gasket may be made of silicone rubber, other suitable materials, or any combination thereof.

In alternative embodiments, the preservation and mixing attachment 120 may be employed to preserve the integrity of other powdered beverages, such as energy drink mixes, sports drink mixes, protein supplement mixes, electrolyte drink mixes, dry lemonade, juice mixes, coffee, tea, other suitable beverage mixes, or a combination thereof.

In such embodiments, the preservation and mixing attachment 120 may be employed with existing bottles, such as, bottles having screw on caps, bottles having a push-pull drinking spout, other suitable bottles, or a combination thereof.

In one embodiment, the exterior surface of the formula retention compartment 122 and/or the hollow compartment 124 may be embellished with different colors, patterns, camouflage patterns, novelty items, ornamental items, stickers, removable stickers, paints, stencils, embossed, engraved, text, logos, designs, images, other decorative materials, or any combination thereof to enhance or otherwise achieve a desired design.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect, to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A preservation and mixing attachment for coupling between a baby bottle container and a baby bottle top comprising:

a container compartment having an open top end and threaded to mate with the baby bottle top;

a hollow compartment having an open bottom end and threaded to mate with the baby bottle container;

a removable seal therebetween that releases into the baby bottle container; and a release actuator for releasing the seal, the release actuator positioned such that the horizontal movement of the release actuator causes vertical movement of the removable seal, wherein the preservation and mixing attachment is open at the top end and at the bottom end before and after releasing the seal.

2. The attachment of claim 1, wherein an exterior surface of the top end of the container compartment is adapted to mate with the baby bottle top.

3. The attachment of claim 1, wherein an interior surface of the bottom end of the hollow compartment is adapted to mate with the baby bottle container.

4. The attachment of claim 1, wherein the removable seal is a plug.

5. The attachment of claim 4, wherein the plug removably seals the container compartment from the hollow compartment, but is fixedly secured to the hollow compartment.

6. The attachment of claim 1, wherein the release actuator for releasing the seal is a pushrod.

7. The attachment of claim 6, further comprising a grommet to sealably secure the pushrod.

8. The attachment of claim 7, wherein the pushrod is slidably disposed through the grommet within a channel to slidably disengage the plug from a locked position.

9. The attachment of claim 1, wherein the removable seal is rubber with a spherical cap geometric shape.

10. The attachment of claim 1, further comprising a gasket to improve the seal or provide ventilation between the hollow compartment and bottle container.

11. The attachment of claim 1 wherein the release actuator is positioned on the side of the attachment.

12. The attachment of claim 1 wherein the removable seal and the release actuator each have an angled surface, and the angled surface of the removable seal matches the angled surface of the release actuator.

* * * * *